US006592336B1

(12) United States Patent
Hirano et al.

(10) Patent No.: US 6,592,336 B1
(45) Date of Patent: Jul. 15, 2003

(54) HYDRAULIC PUMP WITH A BUILT-IN ELECTRIC MOTOR

(75) Inventors: Kenichi Hirano, Kanagawa (JP); Toshio Hashimoto, Kanagawa (JP); Tsuyoshi Kitamira, Kanagawa (JP)

(73) Assignee: Yuken Kogyo Kabushiki Kaisha, Fujisawa (JP)

( * ) Notice: Subject to any disclaimer, the term of this patent is extended or adjusted under 35 U.S.C. 154(b) by 0 days.

(21) Appl. No.: 09/959,176

(22) PCT Filed: Apr. 21, 2000

(86) PCT No.: PCT/JP00/02631

§ 371 (c)(1),
(2), (4) Date: Nov. 28, 2001

(87) PCT Pub. No.: WO00/65230

PCT Pub. Date: Nov. 2, 2000

(30) Foreign Application Priority Data

Apr. 22, 1999 (JP) ..... 11-114882

(51) Int. Cl.[7] ..... F04B 23/14

(52) U.S. Cl. ..... 417/201; 417/348; 417/366; 417/372; 417/269; 417/234

(58) Field of Search ..... 417/201, 348, 417/366, 372, 415, 423.8, 269, 234; 184/6.22, 6.16

(56) References Cited

U.S. PATENT DOCUMENTS

| | | | | |
|---|---|---|---|---|
| 4,480,967 A | | 11/1984 | Schulze | |
| 4,597,717 A | * | 7/1986 | Mohr | 417/265 |
| 5,613,843 A | * | 3/1997 | Tsuru et al. | 417/243 |
| 6,164,924 A | * | 12/2000 | Gruett et al. | 222/231 |
| 6,368,080 B1 | * | 4/2002 | Sipin | 417/415 |

FOREIGN PATENT DOCUMENTS

| | | |
|---|---|---|
| JP | 53-146301 | 12/1978 |
| JP | 57-198391 A | 12/1982 |
| JP | 61-21885 U | 2/1986 |
| JP | 63-94084 A | 4/1988 |
| JP | 1-136540 A | 5/1989 |
| JP | 4-350395 A | 12/1992 |
| JP | 8-103052 A | 4/1996 |
| JP | 10-164793 A | 6/1998 |

OTHER PUBLICATIONS

Patent Abstracts of Japan, Publication No. 01136540 A, Published: May 29, 1989, Inventor: Yamaguchi Akinori, entitled: Cooling Device for Motor.

(List continued on next page.)

*Primary Examiner*—Charles G. Freay
*Assistant Examiner*—Emmanuel Sayoc
(74) *Attorney, Agent, or Firm*—Frishauf, Holtz, Goodman & Chick, P.C.

(57) ABSTRACT

A hydraulic pump with a built-in electric motor wherein an electric motor and a pump unit are arranged in tandem fashion and accommodated within a common housing. In this pump, the housing is in the form of a metal box having a rectangular parallelepiped external shape and forms an electric motor frame fixedly accommodating a stator of the electric motor therein. A space in the metal box on the electric motor side is separated as a dry space from an internal space of said pump unit by a seal mechanism. At least one hydraulic oil receiving chamber is formed in a peripheral wall of the metal box, and the hydraulic oil receiving chamber is communicated with a passage for receiving return oil externally and another passage communicating with a suction port of the pump unit. The pump is capable of simultaneously achieving the cooling of a built-in electric motor and the prevention of contamination of hydraulic oil due to the rotation of the electric motor, without any possibility of electrical troubles with the built-in electric motor even if a water-containing hydraulic oil or aqueous hydraulic oil is fed and discharged.

5 Claims, 5 Drawing Sheets

OTHER PUBLICATIONS

Laid–Open Utility Model Publication of Japan, Publication No. U 61021885 A, Published: Feb. 8, 1986, Inventor: Ogawa Kenji, entitled: Hydraulic Power Unit.

Patent Abstracts of Japan, Publication No. 10164793 A, Published: Jun. 19, 1998, Inventor: Sasahara Toshikazu, entitled: Motor.

Patent Abstracts of Japan, Publication No. 08103052 A, Published: Apr. 16, 1996, Inventor: Ito Yasumitsu, entitled: Cooler of Motor.

Laid–Open Patent Publication of Japan, Publication No. 53146301 A, Published: Dec. 20, 1978, Inventor: Inoue Tatsuo, et al, entitled: Pump.

Patent Abstracts of Japan, Publication No. 63094084 A, Published: Apr. 25, 1988, Inventor: Tagami Masataka, et al, entitled: Pump Unit.

Patent Abstracts of Japan, Publication No. 04350395 A, Published: Apr. 12, 1992, Inventor: M. Takeshi entitled: Pump Device.

* cited by examiner

HYDRAULIC PUMP WITH A BUILT-IN ELECTRIC MOTOR

This application is a U.S. National Phase Application under 35 USC 371 of International Application PCT/JP00/02631 (not published in English) filed Apr. 21, 2000.

FIELD OF THE INVENTION

The present invention relates to a hydraulic pump with a built-in electric motor in which an electric motor and a pump unit that are disposed in tandem along the axis of rotation are received in a common housing.

BACKGROUND OF THE INVENTION

As disclosed, for example, in JP-A-0988807, a hydraulic pump with a built-in electric motor of the type in which an oil-immersed electric motor and a hydraulic pump unit are disposed in tandem along the axis of rotation and interconnected by a common shaft whereby a drain oil discharged from the hydraulic pump unit within a common housing is introduced into and discharged to the outside of the oil-immersed electric motor to thereby cool the electric motor with the pump drain oil, has been known in the art.

Although the hydraulic pump with a built-in electric motor of the type in which the built-in electric motor is immersed and cooled with the drain oil from the pump unit is excellent in cooling efficiency due to the fact that structurally the electric motor coils which are subject to cooling is in direct contact with the hydraulic oil or the cooling medium, in the case where water is introduced into the hydraulic oil or the hydraulic oil itself is an aqueous hydraulic oil, difficulties are encountered in that not only there is the danger of causing such trouble as an electric short-circuiting inside the electric motor, but also very fine metal foreign particles produced within the rotating electric motor tend to enter the hydraulic oil thus making a filter treatment unavoidable for the recirculation of the drain oil and requiring additional time and labor for the maintenance of the hydraulic system including a frequent changing of filters, etc.

Further, in the conventional hydraulic pump with a built-in electric motor, the electric motor-is of the oil immersed construction and its installation posture is permanently fixed so that not only there is a limitation to the installation place within machinery which utilize such pump, but also a piping connection to the hydraulic oil reservoir tank is required thus making it necessary to suffer a certain degree of complication in the construction of the installation portion.

SUMMARY OF THE INVENTION

In view of the foregoing deficiencies in the prior art, it is the primary object of the present invention to provide a hydraulic pump with a built-in electric motor capable of not only simultaneously achieving the cooling of a built-in electric motor and the prevention of contamination of a hydraulic oil due to the rotation of the electric motor, but also preventing the occurrence of electrical troubles with the built-in electric motor even if a water-containing hydraulic oil or aqueous hydraulic oil is fed and discharged. Also, it is another object of the present invention to increase the degree of freedom of design for selecting the installation positions or to make it possible to eliminate the need for piping connection to a reservoir tank.

In accordance with the present invention, there is thus provided a hydraulic pump with a built-in electric motor in which an electric motor and a pump unit are arranged in tandem fashion and accommodated within a common housing. More particularly, the housing is in the form of a metal box having a rectangular parallelepiped external shape and forms an electric motor frame fixedly accommodating a stator of said electric motor therein. A space in the metal box on the electric motor side is separated as a dry or atmospheric space from the internal space of the pump unit by a seal mechanism. At least one hydraulic oil receiving chamber is formed in the peripheral wall of the metal box, and that the hydraulic oil receiving chamber is communicated with a passage for receiving a return oil from the outside and a passage leading to the suction port of the pump unit.

Here, the so-called seal mechanism of the present invention means all kinds of oil leakage seal mechanisms capable of transmission of rotation, e.g., those which smoothly transmit the rotation of the electric motor to the rotor of the pump unit and prevent the leakage of the oil from the internal space of the pump unit to the space on the electric motor side. As regards specific examples of such seal mechanism, where the rotary shaft of the electric motor and the pump unit is composed of a single common shaft, for example, it is possible to cite an annular oil seal disposed adjacent to a bearing in a pump unit case between the electric motor and the pump unit, or alternatively, where the rotary shaft of the electric motor and the rotor rotating shaft of the pump unit are disconnected separate shafts, it is possible to cite a magnetic coupling with an oil leakproof seal so designed that magnets are disposed on the inner peripheral surface of a coupling socket provided on the forward end of the rotary shaft of the electric motor, that corresponding magnets are also disposed on the end of the rotor rotating shaft of the pump unit that is inserted in the socket through a diametrical gap, that the end of the rotor rotating shaft is covered with a seal cap through an annular gap between the magnets and that the opening flange of the seal cap is sealingly fixed to the case side of the pump unit.

In the hydraulic oil pump with a built-in electric motor according to the present invention, the housing forms the electric motor portion and also the electric motor portion within the housing is disposed in the dry space separated from the internal space of the pump unit by the seal mechanism whereby the hydraulic oil sucked into the pump unit flows through the hydraulic oil receiving chamber disposed in the housing peripheral wall separately from the dry space and it does not contact with the rotating parts of the electric motor; thus, there is no danger of the hydraulic oil being contaminated with metal foreign particles emitted from the rotating electric motor and also there is no danger of electrical troubles being caused within the electrical motor due to the hydraulic oil even if the hydraulic oil contains water or the hydraulic oil itself is an aqueous hydraulic operational fluid. Moreover, in the hydraulic pump with a built-in electric motor according to the invention, the housing itself forms a liquid-cooling jacket for cooling the electric motor and therefore the cooling of the electric motor is attained effectively. While, in this case, the generation of heat from the electric motor is caused mainly by the windings of its stator, the stator is attached to the metal box forming the housing and thus the heat generated from the stator windings is directly transmitted to the metal box by heat conduction, thereby ensuring an effective cooling owing to not only the heat dissipation effect of the outer surface of the metal box itself but also the fact that the heat is absorbed through heat conduction by the hydraulic oil in the hydraulic oil receiving chamber through the metal box.

The pump unit is driven by the rotation of the electric motor so that the hydraulic oil sucked from the hydraulic oil receiving chamber is discharged as a pressurized oil and this-pressurized oil is returned as return oil to the hydraulic oil receiving chamber after it has performed a work in an external load actuator connected to the pump. Preferably, the drain oil from the pump unit is also introduced into the hydraulic oil receiving chamber so that although the amount of the drain oil is very small as compared with the return oil, it is sufficient to always cause a flow of the hydraulic oil in the hydraulic oil receiving chamber during the operation of the pump and therefore it is effective not only in cooling the electric motor the flow of the hydraulic oil in the hydraulic oil receiving chamber but also in raising the temperature of the hydraulic oil during the warming-up operation in the cold time such as the winter season.

In order to perform the cooling of the electric motor more effectively, it is effective to add a fan radiator which utilizes the rotation of the electric motor. In this case, the fan radiator is mounted to lie along the end plate of the housing (the metal box) on the electric motor side and the fan radiator is rotated by directly connecting it to the end of the rotary shaft of the electric motor. The return oil and the drain oil flowing into the hydraulic oil receiving chamber are passed through the radiator so that the hydraulic oil within the radiator is air-cooled from the outside of the metal box by an air stream caused by the fan. Note that in this case, it is preferable to add a suitable air stream deflecting structure such as a hood to the fan radiator so that the air stream by the fan flows along the housing surface and it is also preferable to further additionally form heat dissipation fins or grooves in the housing outer surface so as to increase the surface area.

In the hydraulic pump with a built-in electric motor according to the present invention, the housing in the form of the electric motor frame having the electric motor stator internally attached thereto is composed of the metal box of the rectangular parallelepiped external shape so that in the section perpendicular to its axis of rotation, there are four areas of substantially triangular shape at the four corners, respectively, between the external contour of substantially rectangular parallelepiped, preferably square shape and the internal circular space for disposing the electric motor and the pump unit therein and therefore these areas can be utilized for the formation of hydraulic oil receiving chambers.

For instance, assuming that the external dimensions of the square section of the metal box are about 280 mm*280 mm, the inner diameter of the internal space for disposing the electric motor, etc., therein is about 160 mm and the axial length is about 280 mm, the hydraulic oil receiving chambers constituted by the four spaces of substantially triangular sectional shape formed in conformity to the four corner in the peripheral wall of the metal box can be utilized as a reservoir having an inner volume of about 10 liters in total. In the event that a reservoir of a greater volume is required, it is possible to increase the volume by mounting an auxiliary tank to lie on the housing by utilizing the fact that the housing is of the rectangular parallelepiped external shape.

In the hydraulic pump with a built-in electric motor according to the present invention, the housing is rectangular parallelepiped in external shape so that the pump can be installed by selecting either of vertical and horizontal arrangements each selectively using one or the other of the adjoining two sides of the housing as its top surface and the installation posture corresponding to the installation space can be selected. In this case, preferably an opening capable of selectively and detachably mounting therein an air breather and an oil level measuring window is formed in each of the two sides so that as for example, the air breather is mounted in the opening formed in one of the sides serving as the top surface and the oil level measuring window is attached to the opening in the other side in the case of the vertical arrangement, whereas in the case of the horizontal arrangement the mounting of the air breather and the oil level measuring window is reversed with each other. Similarly, when mounting an auxiliary tank, one of these openings is used for communicating the tank with the hydraulic oil receiving chamber and the tank is formed with openings each for selectively mounting the air breather and the oil level measuring window therein in place of the opening used for such communicating purposes.

The foregoing and other objects, features and advantages of the present invention will become more apparent from the following detailed description of its embodiments made with reference to the accompanying drawings.

DESCRIPTION OF PREFERRED EMBODIMENTS

Figure 1:
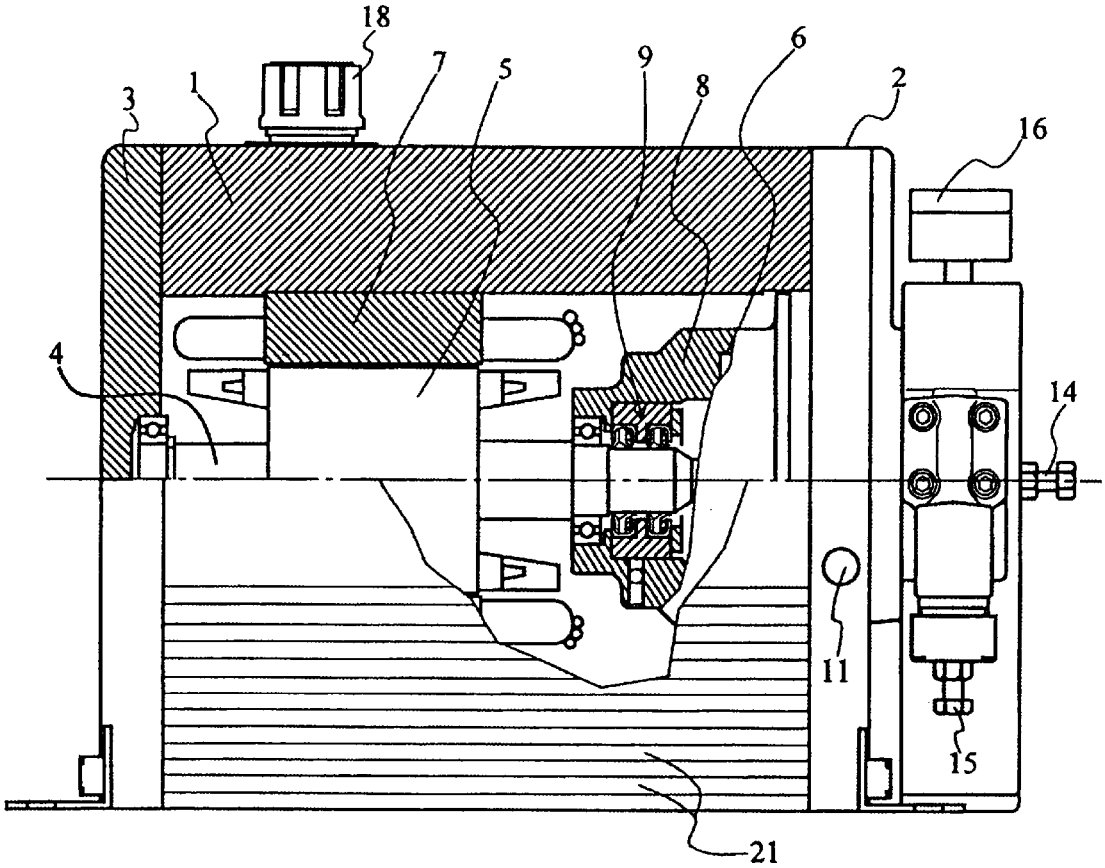
FIG. 1 is an explanatory diagram which is partly cut away to show, as viewed from the side, the principal construction of a hydraulic pump with a built-in electric motor according to a first embodiment of the present invention.

Referring to FIGS. 1 to 6, in a hydraulic pump with a built-in electric motor according to a preferred embodiment of the present invention, a housing is formed by a casted metal box 1 having a substantially square shaped external contour in cross section and end covers 2 and 3 so that a rotor 5 of an electric motor and a rotor 6 of a pump unit are fixedly arranged in tandem fashion along a single-shaft common rotary shaft 4 which is rotatably supported by the end covers within the housing, and a stator 7 of the electric motor is directly attached to the inner surface of the metal box 1 at the position corresponding to the rotor 5; also, the rotor 6 is enclosed by a case 8 of the pump unit which is attached to the front-side end cover 2 so as to be received within the housing thereby accommodating the electric motor and the pump unit within the common housing.

The metal box 1 is a box member having a cubic external shape with its interior forming a cylindrical space, thus forming the peripheral wall of the housing as an electric motor frame having the electric motor stator 7 attached to its inner surface. The electric motor-side space in the metal box 1 is an atmospheric space separated from the space in the case 8 of the pump unit by an oil seal 9 which is an example of a seal mechanism mounted on the rotary shaft 4 in the tail end portion of the pump unit case 8.

Figure 2:
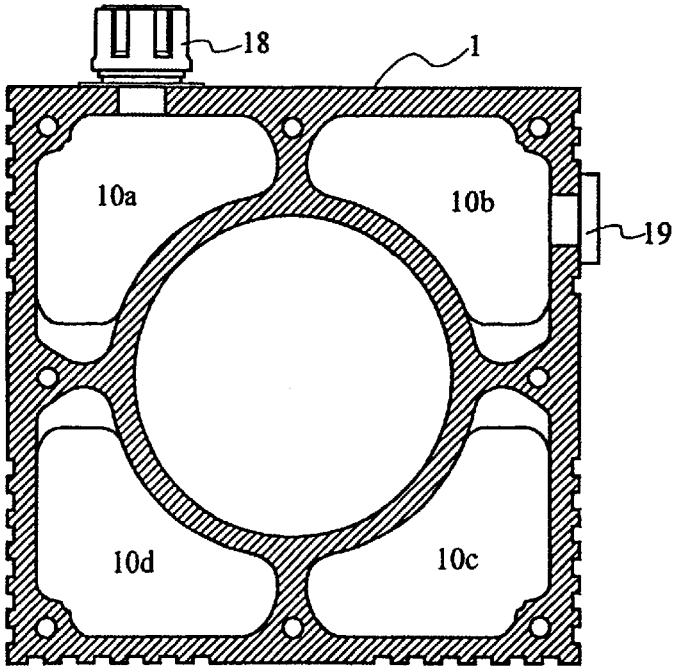
FIG. 2 is a half-cut explanatory diagram showing, as viewed from the back, the right-side half of the housing of the hydraulic pump with a built-in electric motor shown in FIG. 1.
Figure 3:
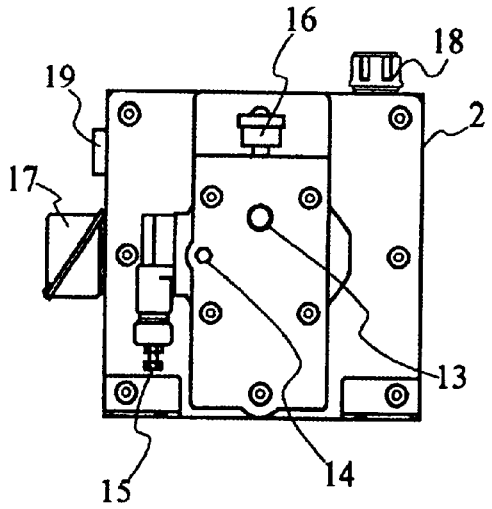
FIG. 3 is a front view showing the external appearance of the hydraulic pump with a built-in electric motor according to the first embodiment.

As shown in FIG. 2, four hydraulic oil receiving chambers 10*a* to 10*d* are in the peripheral wall of the metal box 1, and connected to the hydraulic oil receiving chambers are passages for receiving a return oil from the outside through the end cover 2 and passages leading to the suction port and the drain port of the pump unit. In the meal box 1 forming the housing of the hydraulic pump with a built-in electric motor according to the present embodiment, as viewed in the cross section perpendicular to the rotary shaft 4, there are four areas of substantially triangular shape at the four corners between the external contour of substantially square shape and the internal cylindrical space, and these area are utilized as the areas for forming the hydraulic oil receiving chambers 10*a* to 10*d*.

Note that in the present embodiment the external dimensions of the square section of the metal box 1 are about 280 mm×280 mm, the inner diameter and axial length of its internal cylindrical space are respectively about 160 mm and about 280 mm, and the four hydraulic oil receiving chambers 10*a* to 10*d* having substantially triangular sectional shape and formed at the four corners in the peripheral wall of the metal box 1 can be utilized as a reservoir having an inner volume of about 10 liters in total.

Figure 6:
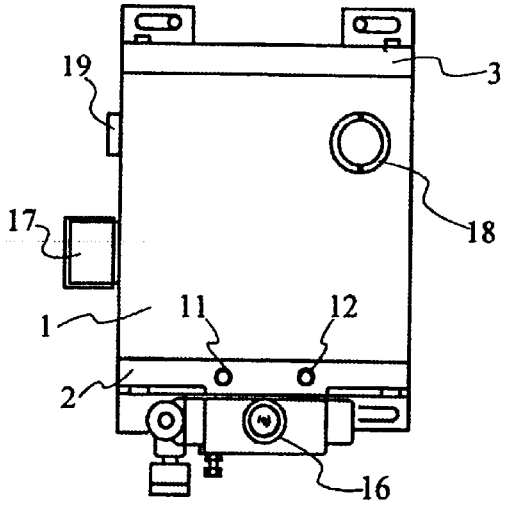
FIG. 6 is a plan view showing the external appearance of the hydraulic pump with a built-in electric motor according to the first embodiment.

The end cover 2 on the housing front side is a pump cover fastened to the pump case 8 by flange joining with bolts and, as shown in FIG. 6, this pump cover is provided with a tank port 11 (on the left side as viewed from the front), a drain port 12 (similarly on the right side) on the housing top surface side and a discharge port 13 (FIG. 3) on the housing front side for external connection purposes. The tank port 11 and the internal drain port are communicated with the hydraulic oil receiving chamber 10*b* on the top left side, and the suction port of the pump unit is communicated with the hydraulic oil receiving chamber 10*a* on the top right side. Also, arranged on the front side of the pump cover 2 are a delivery rate adjusting screw 14, a pressure regulating screw 15 and a pressure gauge 16 for the pump unit with the gauge 16 having its display face turned upward. It is to be noted that mounted about the center of the housing left side face is a terminal block case 17 for the electric wirings provided mainly for the electric motor.

The end cover 2 is provided with internal passages (not shown) for respectively connecting the upper and lower hydraulic oil receiving chambers 10*b*, 10*c* and 10*a*, 10*d* of the metal box 1 on the left and right sides, whereas the end cover 3 on the housing back side is provided with an internal passage for internally connecting the lower left and right hydraulic oil receiving chambers 10*c* and 10*d* of the metal box 1 with each other. By virtue of the connection of the respective hydraulic oil receiving chambers by the internal passages of the end covers 2 and 3, a continuous path is formed so that the return oil directed to the tank port 11 from the outside and the internal drain oil of the pump unit are sequentially passed through the respective hydraulic oil receiving chambers so as to reach the suction port of the pump unit. In the illustrated embodiment, this path is in the order of the hydraulic i receiving chambers 10*b*, 10*c*, 10*d* and 10*a*.

Figure 4:
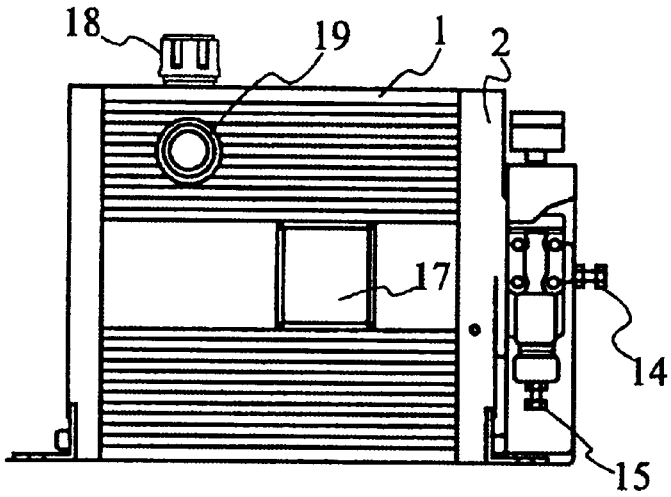
FIG. 4 is a left side view showing the external appearance of the hydraulic pump with a built-in electric motor according to the first embodiment.
Figure 5:
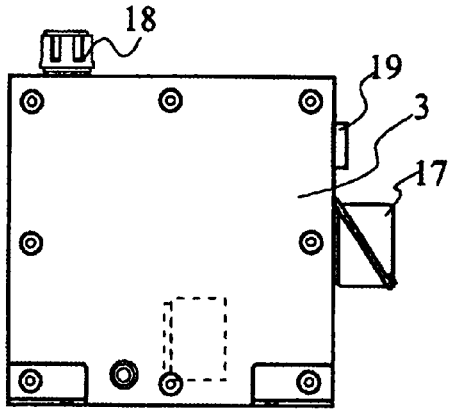
FIG. 5 is a rear view showing the external appearance of the hydraulic pump with a built-in electric motor according to the first embodiment.
Figure 10:
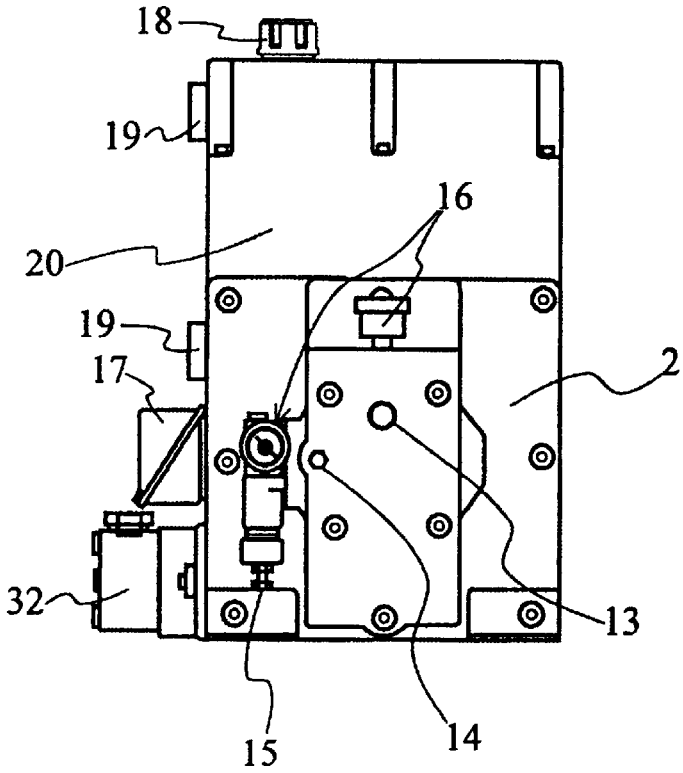
FIG. 10 is a front view of the vertically arranged pump with the addition of an auxiliary tank.
Figure 11:
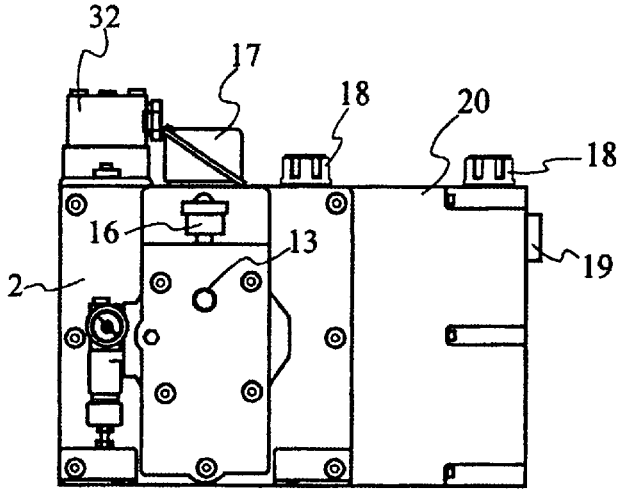
FIG. 11 is a front view of the horizontally arranged pump with the addition of an auxiliary tank.

As will be best seen from FIG. 4, an opening concurrently serving as an oil filling port is formed in the housing top so as to communicate with the hydraulic oil receiving chamber 10*a* through the peripheral wall of the housing and an air breather 18 is removably mounted in this opening in the illustrated condition. Similarly, another opening concurrently serving as an oil filling port is also formed in the left side face of the housing at the position corresponding to the previous opening so as to communicate with the hydraulic oil receiving chamber 10*b* through the housing peripheral wall, and an oil level measuring window 19 is removably mounted in this opening in the illustrated condition. These openings respectively formed in the housing top and left side face are concurrent openings in which the air breather 18 and the oil level measuring window 19 can be changeably mounted, and also the housing top opening having the air breather 18 mounted therein in the illustrated condition can be used as a through hole which provides a communication between an auxiliary tank (20: FIGS. 10 and 11) and the hydraulic oil receiving chamber 10*a* when the auxiliary tank is additionally installed as will be described later.

In the hydraulic pump with a built-in electric motor according to the present embodiment, the housing constitutes the electric motor frame and the electric motor portion within the housing is in the dry space separated from the internal space of the pump unit by the oil seal 9, with the result that the return oil arriving the tank port 11 and the drain oil flow by passing sequentially through the respective hydraulic oil receiving chambers arranged in the housing peripheral wall independently of the dry space and are sucked into the suction port of the pump unit, thereby causing the housing itself to serve as a liquid-cooling jacket for cooling the electric motor. While the heat generation of the electric motor is mainly produced from the windings of the stator 7, the stator is attached to the inner surface of the metal box 1 forming the housing so that the heat generated from the stator windings is directly transmitted by heat conduction to the metal box 1 and the generated heat is absorbed by heat conduction by the hydraulic oil in the respective hydraulic oil receiving chambers through the metal box 1 in addition to the heat dissipation effect of the outer surface of the metal box itself, thereby making it possible to effectively cool the electric motor. Also, in this case, the hydraulic oil does not contact with the rotating parts of the electric motor so that there is no danger of the hydraulic oil being contaminated with metal foreign particles produced from the rotating electric motor and also there is no danger of causing any electric trouble e.g., a short-circuiting in the electric motor even in the case where the hydraulic oil contains water or the hydraulic oil itself is an aqueous hydraulic oil.

When the rotor 6 of the pump unit is driven by the rotation of the rotor 5 of the electric motor, the pump unit discharges the hydraulic oil sucked from the hydraulic oil receiving chambers as a pressurized oil from the discharge port 13 and the pressurized oil is returned as a return oil to the hydraulic oil receiving chambers through the tank port 11 after it has performed a work in an external load actuator (not shown) connected to the pump. The drain oil from the pump unit is also introduced into the hydraulic oil receiving chambers so that although the amount of the drain oil is very small as compared with the return oil, it is sufficient to always cause a flow of the hydraulic oil in the hydraulic oil receiving chambers during the operation of the pump and therefore not only the cooling of the electric motor by the flow of the hydraulic oil in the hydraulic oil receiving chambers is made effective but also it is effective raising the oil temperature of the hydraulic oil during, for example, the warming-up operation a cold time such as the winter season.

Figure 7:
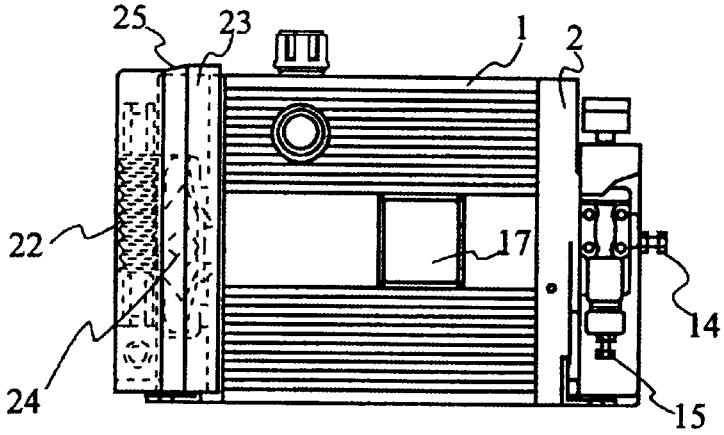
FIG. 7 is a left side view of a hydraulic pump with a built-in electric motor according to a modified embodiment additionally including a fan radiator.
Figure 8:
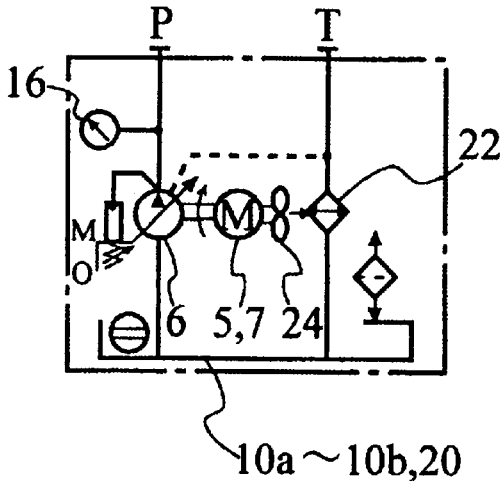
FIG. 8 is a circuit diagram showing the construction of the modified embodiment by means of graphical hydraulic circuit symbols.

While a plurality of fins or grooves 21 are formed in the left and right side faces of the metal box 1 constituting the housing outer peripheral surface so as to increase the heat dissipation area, a fan radiator 22 utilizing the rotation of the electric motor can be added as shown in FIG. 7 so as to perform the cooling of the electric motor more effectively. In this case, it is only necessary to replace the motor-side end plate 3 of the housing (the metal box) with a radiator mounting end plate 23 of a special specification and the fan radiator 22 is assembled to lie along the end plate 23 so as to rotate a fan 24 of the radiator by directly connecting it to the end of the rotary shaft 4 of the electric motor by a socket joint system, for example. The end plate 23 contains therein passages for communication between the respective hydraulic oil receiving chambers and the interior of the radiator so that the interconnection between the left and right hydraulic oil receiving chambers 10*a*, 10*b* and 10*c*, 10*d*, respectively, are effected within the radiator in place of the end plate 3. The return oil and the drain oil flowing into the hydraulic oil receiving chambers pass through the interior of the radiator so that the hydraulic oil within the radiator is air-cooled by an air stream caused by the fan 24. A hood 25 is also mounted on the fan radiator so as to deflect the generated air stream to flow along the housing outer peripheral surface from the back side to the front side and this makes a more effective cooling possible. The construction of this modified embodiment is as shown by the hydraulic circuit diagram of FIG. 8 and the corresponding component elements are designated by the same reference numerals.

Figure 9:
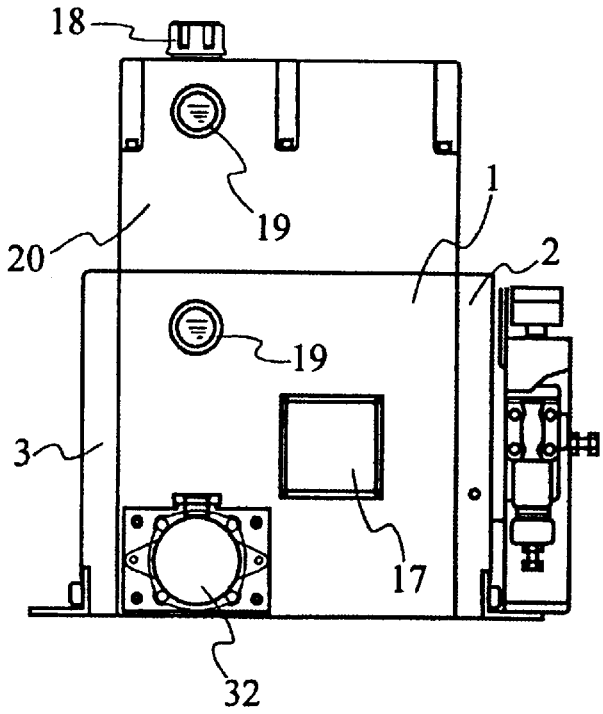
FIG. 9 is a side view showing an example of a vertically arranged pump with the addition of an auxiliary tank.

As mentioned previously, in the present embodiment the metal box 1 itself forms the hydraulic oil receiving chambers of about 10 liters in volume; however, in the event that a reservoir of a greater volume is required in the pump utilizing the same housing, the fact that the external shape of the housing is rectangular parallelepiped is utilized so that an auxiliary tank 20 is mounted by placing it on the housing as shown in FIGS. 9 to 11 to increase the volume of the reservoir. Formed in the top of the auxiliary tank 20 are openings of the same specifications as the openings respectively formed in the top and left side faces of the metal box 1 so as to concurrently serve as oil filling ports and selectively mount therein the air breather 18 and the oil level measuring window 19, and also formed through the bottom surface of the auxiliary tank is an opening which is connected with the opening in the top of the metal box 1 to form a communicating opening when the auxiliary tank is placed on the top of the metal box 1.

FIGS. 9 and 10 show an example of a vertically arranged posture in which the hydraulic pump shown in FIGS. 1 to 6 is used in its posture as such and the auxiliary tank 20 is arranged to lie on the top of the metal box 1; thus, the auxiliary tank 20 is communicated with the interior of the hydraulic oil receiving chamber 10*a* through the opening in the top of the metal box 1 from which the air breather 18 has been removed and the air breather 18 which had been on the top of the metal box 1 is now mounted in the similar opening (serving concurrently as an oil filling port) in the top of the auxiliary tank 20. In the case of the present embodiment, the auxiliary tank 20 has a volume of about 10 liters thereby realizing a reservoir volume of about 20 liters in total.

In the hydraulic pump with a built-in electric motor according to the present invention,its housing has a rectangular parallelepiped external shape so that it is possible to install the pump by selectively using a vertically installed arrangement and a horizontally installed arrangement each of which selectively utilizes as its top one or the other of the adjoining two sides of the housing and the desired installation posture can be selected in conformity with the installation space. Of these arrangements, an example of the vertically installed arrangement is as shown in FIGS. 9 and 10, and an example of the horizontally installed arrangement is as shown in FIG. 11.

In the case of the horizontally installed arrangement, the end plates 2 and 3 (or the end plate 23) are left in their positions as such and the metal box 1 alone is tilted 90 degrees about the rotary shaft 4 to rearrange such that the previous top is now the right side face and the previous left side face is now the top. Thus, the opening having the air breather 18 mounted therein in FIGS. 1 to 6 is now the opening for connection with the auxiliary tank 20 and the air breather 18 is mounted in the opening having previously mounted therein the oil level measuring window 19 (the opening concurrently serving as the oil filling port); also, the oil level measuring window 19 is mounted in the top opening of the auxiliary tank 20 in which the air breather is mounted in the case of the vertically installed arrangement.

Figure 12:
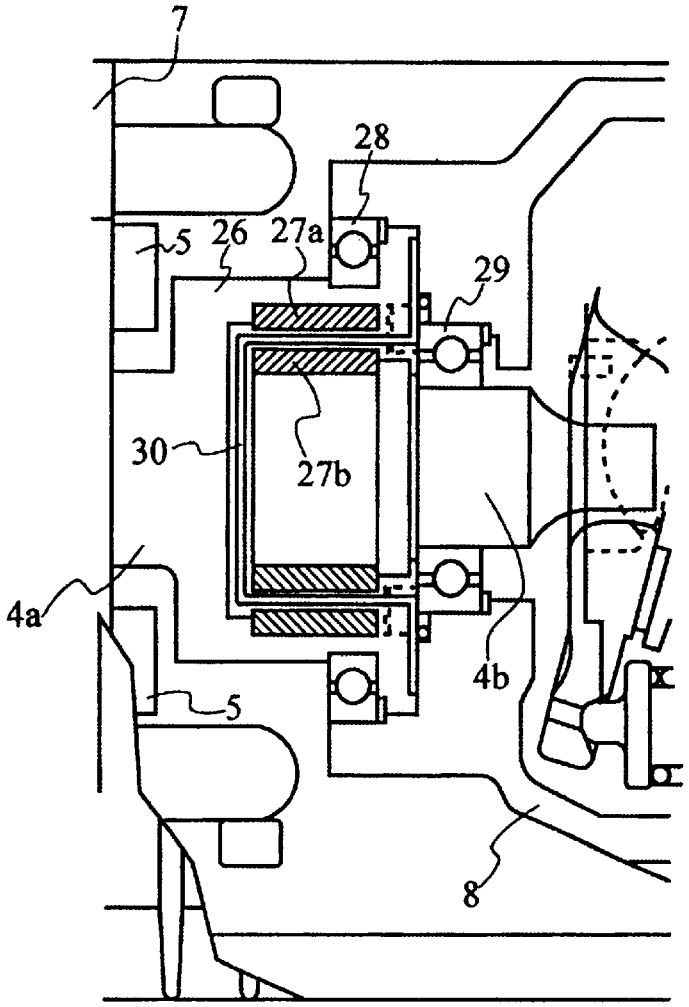
FIG. 12 is a principal sectional view of another modified embodiment showing another exemplary seal mechanism.

FIG. 12 shows another example of the seal mechanism. This modified embodiment uses a separate shaft construction in which a rotary shaft 4*a* of an electric motor and a rotor rotating shaft 4*b* of a pump unit are separated from each other, and attached to the forward end of the electric motor rotary shaft 4*a* is a coupling socket 26 having attached to the inner peripheral surface thereof a plurality of circumferentially split magnet pieces 27*a*.

An external bearing 28 rotatably supports the forward end of the coupling socket 26 at the end of a pump case 8 and an internal bearing 29 rotatably supports the rotor rotating shaft 4*b*. The rotor rotating shaft 4*b* of the pump unit is inserted in the socket 26 through a diametrical gap and attached to the end of the shaft 4*b* are a plurality of magnet pieces 27*b* which correspond to but differ in number from the magnet pieces 27*a*. The magnet pieces 27*a* and 27*b* constitute a magnetic coupling which transmits a rotary torque by magnetic attractive force between the magnet pieces 27*a* and 27*b* through an annular gap so that the rotor rotating shaft 4*b* of the pump unit is driven into rotation by the rotary shaft 4*a* of the electric motor.

The end of the rotor rotating shaft 4*b* projects to the outside of the pump case 8 and its outer side is covered in an oil-tight manner by a seal cap 30. The seal cap 30 is made from a nonmagnetic material such as stainless steel, copper alloy or plastic material which is formed into a bottomed cylindrical shape with an externally extended flange portion at its opening edge and it has a thickness which seals against the leakage of the oil with a sufficient mechanical strength without any loss of the magnetic attractive force between the magnet pieces 27*a* and 27*b*. The opening edge of the seal cap 30 is sealingly attached to the end face of the pump case 8 so that the seal cap 30 is a nonrotating part with its peripheral wall portion positioned in the annular gap between the magnet pieces 27*a* and 27*b*, and the external and internal magnet pieces 27*a* and 27*b* are in a relatively rotatable relation with each other.

It is to be noted that the foregoing embodiments and modifications are only for the purpose of showing some typical embodiments of the present invention and it should be understood that any other modifications which are obvious to those skilled in the art belong to the technical scope of the present invention. For instance, it is of course possible to make such modifications including one in which a return filter unit 32 is mounted on the side face of the metal box 1 as shown in FIGS. 9 to 11, another in which various oil pressure control valve, pressure regulating valve, selector valve, manifolds, etc., are stacked up and arranged on the outer surface of the pump cover by utilizing the fact that the pump unit is collectively arranged on the end cover 2 side, and still another in which a delivery rate sensor required for electrically controlling the hydraulic pump, such as, a potentiometer for detecting the tilt angle of a swash plate in the case of the pump unit composed of an axial piston pump assembly, a pressure sensor for producing an electric signal indicative of the delivery pressure or the like is incorporated in the pump cover.

As described hereinabove, by virtue of the fact that in the hydraulic pump with a built-in electric motor according to the present invention the housing forms the electric motor frame, that the electric motor portion in the housing is in the dry space separated from the internal space of the pump unit by the seal mechanism and that the hydraulic oil sucked into the pump unit flows through the hydraulic oil receiving chambers arranged in the housing peripheral wall independently of the dry space and so it does not contact with the rotating parts of the electric motor,there is no danger of any metal foreign particles produced by the rotating electric motor entering the hydraulic oil and also there is no danger of electric troubles being caused within the electric motor due to the hydraulic oil containing water or an aqueous hydraulic oil constituting the hydraulic oil itself. Moreover, the housing itself forms a liquid-cooling jacket for cooling the elect motor with the result that the heat generated from the electric motor is absorbed through heat conduction by the hydraulic oil in the hydraulic oil receiving chambers through the metal box in addition to the heat dissipation effect of the outer surface of the metal box itself and therefore the electric motor can be effectively cooled by this fact coupled with the flowing of the hydraulic oil in the hydraulic oil receiving chambers.

In addition, a fan radiator utilizing the rotation of the electric motor can be added so as to cool the electric motor more effectively, and also a still increased cooling effect can be attained by causing the return oil and the drain oil flowing into the hydraulic oil receiving chambers to pass through the radiator so as to air-cool the hydraulic oil in the radiator from the outside of the metal box by an air stream caused by the fan.

Further, in the hydraulic pump with a built-in electric motor according to the present invention the housing in the form of the electric motor frame having the electric motor stator internally attached thereto is composed of the metal box of the rectangular parallelepiped external shape so that in the section perpendicular to its axis of rotation, there are four areas of substantially triangular shape at the four corners between the external contour of substantially rectangular parallelepiped shape, preferably square shape and the circular space for disposing the electric motor and the pump unit therein and thus these areas can be used for its hydraulic oil receiving chambers so as to provide a hydraulic pump with a built-in electric motor having a compact external shape and including a reservoir; moreover, where a reservoir of a greater volume is required, it is possible to increase the volume by mounting an auxiliary tank so as to lie on the housing by utilizing the fact that the external shape of the housing is rectangular parallelepiped, and in this case there is also the advantage that the installation can be effected by making a selection between a horizontally installed arrangement and a vertically installed arrangement each utilizing one or the other of the adjoining two faces of the housing of the rectangular parallelepiped external shape as its top face, and the installation posture can be selected in accordance with the installation space.

What is claimed is:

1. A hydraulic pump comprising:

an electric motor and a pump unit arranged in tandem fashion and accommodated within a common housing, wherein said housing is in the form of a metal box having a rectangular parallelepiped external shape and forms an electric motor frame fixedly accommodating a stator of said electric motor therein, wherein a space in said metal box on said electric motor side is separated as a dry space from an internal space of said pump unit by a seal mechanism, wherein at least one hydraulic oil receiving chamber is formed in a peripheral wall of said metal box, wherein said hydraulic oil receiving chamber is communicated with a passage for receiving return oil externally and another passage communicating with a suction port of said pump unit, and wherein a fan radiator including a fan coupled to a rotary shaft of said electric motor is attached to one end cover of said housing which is on a side of said electric motor whereby the return oil and drain oil flowing into said hydraulic oil receiving chamber are passed through said fan radiator so as to air-cool the hydraulic oil within said radiator from outside of said metal box by an air stream caused by said fan.

2. A hydraulic pump comprising:

an electric motor and a pump unit arranged in tandem fashion and accommodated within a common housing, wherein said housing is in the form of a metal box having a rectangular parallelepiped external shape and forms an electric motor frame fixedly accommodating a stator of said electric motor therein, wherein a space in said metal box on said electric motor side is separated as a dry space from an internal space of said pump unit by a seal mechanism, wherein at least one hydraulic oil receiving chamber is formed in a peripheral wall of said metal box, wherein said hydraulic oil receiving chamber is communicated with a passage for receiving return oil externally and another passage communicating with a suction port of said pump unit, and wherein a plurality of hydraulic oil receiving chambers are constituted by four spaces of substantially triangular sectional shape formed in correspondence to four corners in the peripheral wall of said metal box.

3. A hydraulic pump with a built-in electric motor as set forth in claim 1, wherein a plurality of hydraulic oil receiving chambers are constituted by four spaces of substantially triangular sectional shape formed in correspondence to four corners in the peripheral wall of said metal box.

4. A hydraulic pump with a built-in electric motor as set forth in claim 1, wherein an auxiliary tank for communicating with-said hydraulic oil receiving chamber is additional mounted so as to be placed on said housing.

5. A hydraulic pump with a built-in electric motor as set forth in claim 2, wherein an auxiliary tank for communicating with said hydraulic oil receiving chambers is additionally mounted so as to be placed on said housing.

* * * * *